United States Patent [19]

Helding et al.

[11] Patent Number: 4,790,577

[45] Date of Patent: Dec. 13, 1988

[54] DOOR PUSH-BAR LOCK-OUT RETAINER

[76] Inventors: Curtis L. Helding, 2803 Fleetwood Dr.; Carl R. Larrabee, 4234 Wood Rd., both of Racine, Wis. 53403

[21] Appl. No.: 161,496

[22] Filed: Feb. 29, 1988

[51] Int. Cl.[4] ..... E05B 65/10

[52] U.S. Cl. ..... 292/92; 292/21; 70/92; 70/465

[58] Field of Search ..... 292/92, 21, 336.3, 347, 292/253; 70/92, 209, 465, 158, 207, 416, 422

[56] References Cited

U.S. PATENT DOCUMENTS

| | | | |
|---|---|---|---|
| 1,357,007 | 10/1920 | Smith | 292/21 |
| 1,899,466 | 2/1933 | Kistner | 292/5 X |
| 2,212,957 | 8/1940 | Spradling | 292/92 |
| 3,214,947 | 11/1965 | Wikkerink | 292/92 X |
| 3,722,938 | 3/1973 | Bauer et al. | 292/92 |
| 3,945,670 | 3/1976 | Peterson | 292/92 |
| 4,331,354 | 5/1982 | Helding et al. | 292/92 |

FOREIGN PATENT DOCUMENTS

| | | | |
|---|---|---|---|
| 20516 | of 1898 | United Kingdom | 292/92 |
| 23132 | of 1902 | United Kingdom | 292/92 |
| 214854 | 5/1924 | United Kingdom | 70/92 |

*Primary Examiner*—Lloyd A. Gall
*Assistant Examiner*—Curtis B. Brueske
*Attorney, Agent, or Firm*—Arthur J. Hansmann

[57] ABSTRACT

A door push-bar lock-out retainer which includes a block for mounting onto a door and it has a flexible strap for surrounding the push-bar and holding it in the door unlatched position. The strap is adjustable to accommodate various sizes of push-bars. The block has an opening which receives one end of the strap which has a latch end which is trapped in the opening by a latch member on the block. A key is utilized for releasing the strap from the latched position to thereby release the push-bar and thereby place the door in its locked position.

7 Claims, 1 Drawing Sheet

DOOR PUSH-BAR LOCK-OUT RETAINER

This invention relates to a restrainer device which holds a door push-bar in the unlatched position such that the door can be opened from the outside.

BACKGROUND OF THE INVENTION

Push-bar restrainers, or lock-out devices, are commonly known in the prior art. U.S. Pat. Nos. 1,357,007 and 2,212,957 and 3,722,938 and 4,331,354 are examples of the prior art showing mechanisms for holding the push-bar in the lock-out position. That is, devices are utilized for holding the push-bar down so that the door can be opened from the outside without any special key or the like.

The present invention improves upon the prior art in that it is a simplified but yet sturdy device which requires a special tool or key for releasing the device from its restraining position relative to the push-bar, and, there is only minimum amount of hardware on the door itself, so that one can normally depress the push-bar without fear of pinching one's fingers between the push-bar and the device.

The prior art devices permit themselves to be readily release from a restraining position, by anyone on the interior side of the door, so that the restrainer can be circumvented, since no special key or the like is required for releasing the device. Also, the prior art devices are commonly constructed of metal material which engages the push-bar and can therefore scratch and mar the bar, and the present invention avoids the aforementioned features.

Still further, the present device is arranged so that it can be readily adjusted to adapt to the dimensions of a particular door having a push-bar, and the adjustment can be made simply with a screwdriver and it can be made at the installation on the door itself.

DETAILED DESCRIPTION OF THE PREFERRED EMBODIMENT

Figure 1:
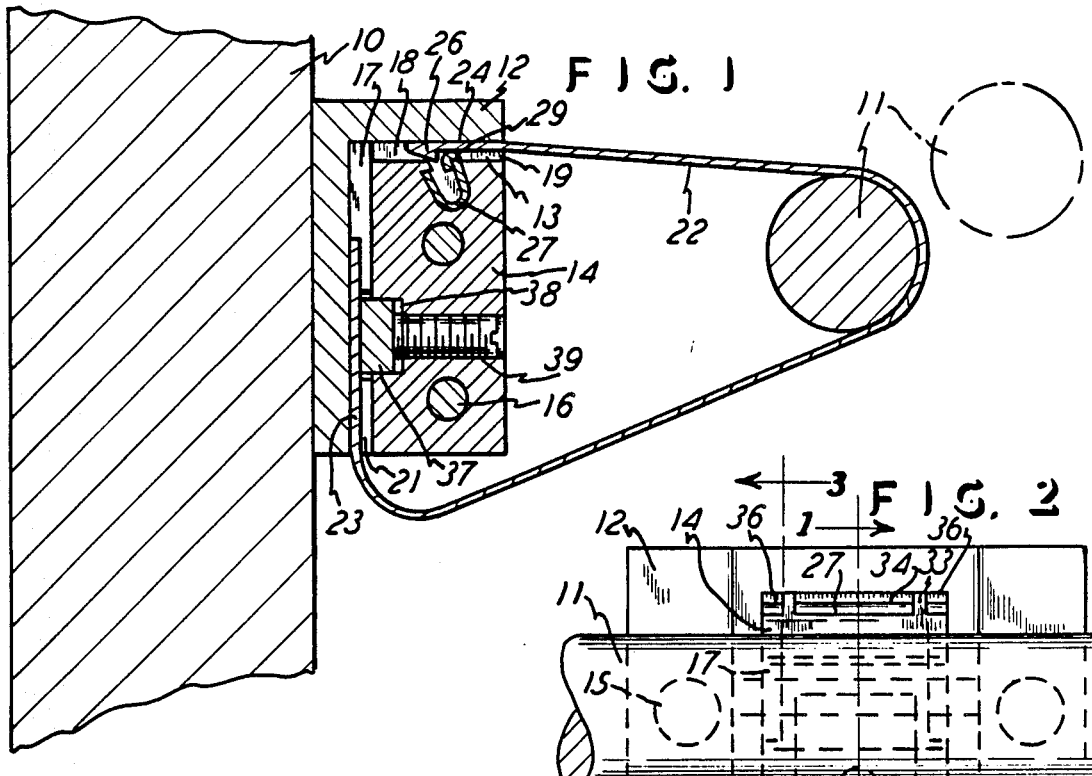
FIG. 1 is a sectional view of a preferred embodiment of a retainer of this invention, and with the view being taken on the line 1—1 of FIG. 2.

FIG. 1 shows a door 10 with a push-bar 11 which should be understood as being attached to the door in the normal fashion of a push-bar, such as shown in U.S. Pat. No. 3,722,938, for instance. Therefore, the bar moves between the door latched position, shown by the dot-dash display of the bar 11, and the unlatched position, as shown by the solid line display of the bar 11. Of course in the unlatched position, the door 10 can be open from the exterior, that is, the left side, as viewed in FIG. 1. It is of course desirable, at times, to have the push-bar 11 retained in that solid line or lock-out position so that the door 10 can be opened from the outside without depressing the bar 11 on the inside of the door 10.

Figure 2:
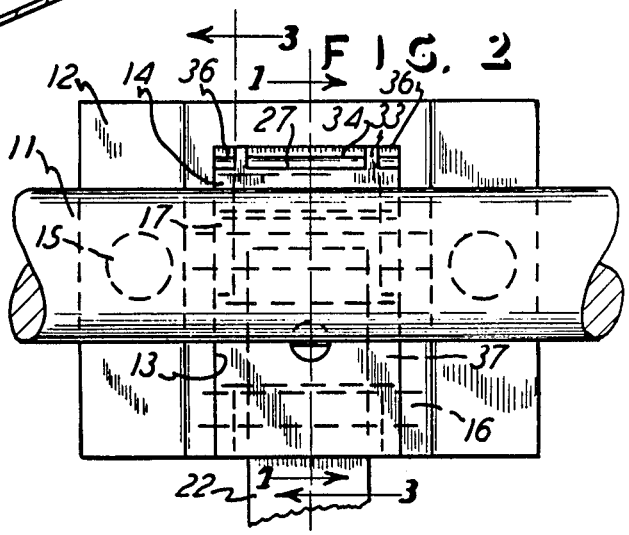
FIG. 2 is a front-elevational view of the showing in FIG. 1, with the device being in the unlatched position.
Figure 5:
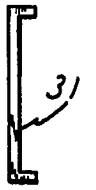
FIG. 4 and FIG. 5 are top and end views, respectively, of the release key.
Figure 4:
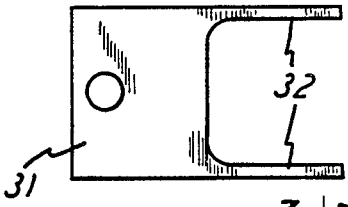

The retainer of this invention includes a block 12 which is suitably attached to the inside face of the door 10, such as by screws designated 15 in FIG. 2. The block 12 includes a central opening designated 13 which receives a member 14 which is part of the block 12 and is held thereto by means of screws 16 extending through the block parts 12 and 14. Corner or shoulder portions 17 and 18 are integral with the part 12 and bear against the respective surfaces of the part 14, for positioning the part 14 relative to the part 12 and thereby providing openings 19 and 21 between the parts 12 and 14.

A restrainer, in the form of a flexible strap 22 has its one end 23 received in the opening 21, and it has its other end 24 received in the opening 19, all as shown in FIG. 1. The strap 22 is preferably of a flexible material, such as plastic, fabric, or any flexible material which permits maneuvering and positioning of the strap 22 for surrounding the outer portion of the push-bar 11 and for insertion into the block opening 19, all as shown in FIG. 1. In that FIG. 1 position, the push-bar 11 is being retained in the lock-out position by means of the restrainer or strap 22.

Figure 6:
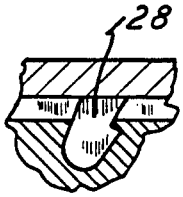
FIG. 6 is a sectional view of a fragment of FIG. 3, with the spring removed.
Figure 3:
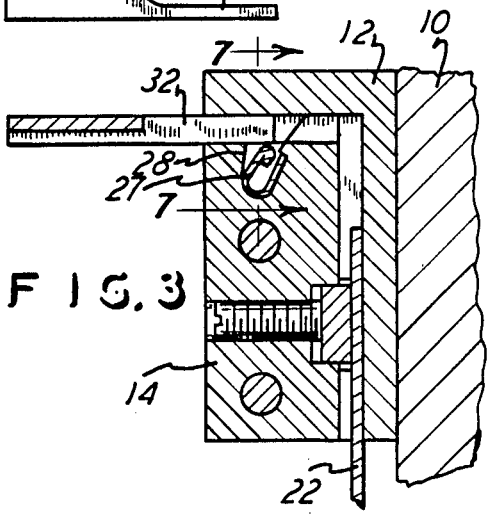
FIG. 3 is a sectional view taken on the line 3—3 of FIG. 2, and with the release key added thereto. The section extends vertically along the vertical lines 3—3, and thence horizontally along the shown section lines on the horizontal plane which lies slightly above the cylindrical push-bar, as seen by the shown section lines 3—3.
Figure 7:
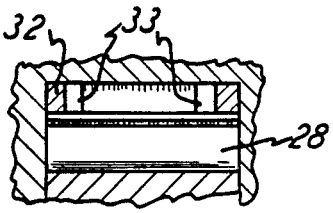
FIG. 7 is a sectional view taken along the line 7—7 of FIG. 3, and with the spring removed.

FIG. 1 further shows that the strap end 26 is enlarged, in the form of one-half of an arrowhead, as shown, and it is insertable into the opening 19 to pass beyond a flat spring 27 seated in an opening 28 in the part 14, as best seen in FIGS. 3, 6, and 7 The spring 27, and its correspondingly shaped opening 28, extend for the width of the part 14, and the spring 27 actually extends throughout, as seen in FIG. 2 and it therefore extends for the full width of the opening 13 in the block part 12.

In the lock-out or latched position of FIG. 1, the spring 27 has its latch end 29 in the opening 19 and thus in interference position relative to the strap enlargement or head 26. As such, it prevents the strap 22 from being withdrawn rightwardly from the opening 19, that is, from being removed from the block parts 12 and 14.

To effect release, or the unlatched mode, a key 31, or some similar tool, is required for engaging the spring end 29 and depressing the end to a position of clearance relative to the strap enlargement or head 26. That unlatched and depressed position is shown in FIG. 3. The key 31 has two tines or prongs 32 which are of a size to be received in the opposite ends of the opening 19, and the tines 32 engage the ends of the spring 28 to depress the spring head 29, as shown in FIG. 3. Of course the strap 22 is of a narrower width than that of the spring 27, as well as being of a narrower width than that of the opening 19, and thus the key tines 32 can be inserted to straddle the strap 22 and to engage only the opposite ends of the spring head 29 for depressing the spring to the unlatched position shown in FIG. 3. The strap head 26 can then be withdrawn from the opening 19 to release the push-bar 11 so that it will, under the customary spring urging, go to the dot-dash position shown in FIG. 1 and thereby place the door itself in the latched position.

FIGS. 2 and 7 show the part 14 has two ribs 33 extending the depth of the part 14, and thus the two ribs 33 divide the opening 19 into a large central opening 34, for reception of the strap head 26, and the two side openings 36 which are key holes.

Therefore, to release or unlatch the retainer of this invention, a tool, such as the key 31, is required, and this therefore reduces the tampering and abuse concern with respect to the lock-out retainer To provide for adjustment of the overall effective length of the strap 22 outside the block parts 12 and 14, a bar 37 is received in an opening 38 in the part 14, and the bar is in contact with the strap end 23, as shown in FIGS. 1 and 3. The end 23 can be inserted into the opening 21, to an adjustable amount in accordance with the height of the opening 21. The part 38 then bears against the strap end 23, and is held by the screw 39. In that manner, the effective length of the strap 22 is adjustable by means of loosening the screw 39 and adjusting the insertion of the strap end 23 in the opening 21.

Also, since the strap 22 is made of a flexible material, it is soft and will not abrade, scratch, or otherwise mar the push-bar 11, even though the strap is in snug position with the bar 11 when the retainer is in the door unlatched position of FIG. 1.

The strap 22 is thus swingably mounted on the block part 12 and 14, and it has the latch portion 26 complimentary with the latch portion 24 of the spring 27.

What is claimed is:

1. A door push bar lock-out retainer of the type used on a hingedly mounted door having a push bar swingably mounted on said door and spaced from said door and extending horizontally and being movable for swinging toward and away from said door and being in a door-unlocked position when swung in toward said door, comprising a block mountable on said door and having a latch opening therein, a restrainer having an end attached to said block to be swingably mounted on said block and extending therefrom in a portion engageable with said push bar for holding said push bar in the door-unlocked position, said restrainer having a latch portion insertable into said latch opening, a spring in said block adjacent said latch opening for releasably engaging said latch portion and thereby releasably secure said restrainer to said block, and a key insertable into said block and operative on said spring for deflecting said spring for releasing said latch portion from said block.

2. The door push bar lock-out retainer as claimed in claim 1, wherein said latch portion and said spring have interengaging overlapping protrusions for releasably trapping said restrainer in said block.

3. The door push bar lock-out retainer. As claimed in claim 1, wherein said block has a key hole for reception of said key, and the spring pressure of said spring is directed toward said key hole, and said key is insertable into said block through said key hole to overcome the spring pressure for releasing said restrainer.

4. The door push bar lock-out retainer as claimed in claim 1, wherein said restrainer is a strap of flexible material movable between the door unlocked position and a position suspended from said block, and said latch portion being an enlargement on the end of said strap opposite said end thereof attached to said block and being slidable into said latch opening and into releasable engagement with said spring.

5. The door push bar lock-out retainer as claimed in claim 1, wherein said spring and said restrainer both have protrusions thereon disposed for overlapping engagement with each other in the door unlocked position and thereby presenting the latch portion and the releasable function.

6. The door push bar lock-out retainer as claimed in claim 1, including adjustment means for attaching said restrainer to said block in an adjustable attachment whereby said restrainer extends from said block in selectively adjustable lengths.

7. The door push bar lock-out retainer as claimed in claim 1, wherein said spring is a U-shape with ends relatively movable toward and away from each other, and with one of said spring ends having a protrusion, and said latch portion being arranged to overlap with said protrusion for releasably securing said restrainer to said block.

* * * * *